United States Patent [19]

Shindow et al.

[11] Patent Number: 4,522,892

[45] Date of Patent: Jun. 11, 1985

[54] METHOD FOR PRODUCING A STEEL STRIP HAVING AN EXCELLENT PHOSPHATE-COATING PROPERTY

[75] Inventors: Yoshio Shindow; Masaya Tsutsumi; Wataru Hotta; Yujiro Miyauchi, all of Kimitsu, Japan

[73] Assignee: Nippon Steel Corporation, Tokyo, Japan

[21] Appl. No.: 482,969

[22] Filed: Apr. 8, 1983

[30] Foreign Application Priority Data

Apr. 17, 1982 [JP] Japan ..... 57-64586

[51] Int. Cl.[3] ..... C25D 11/36

[52] U.S. Cl. ..... 428/628; 204/28; 204/34; 204/35.1; 204/42; 204/56 R; 428/659

[58] Field of Search ..... 204/28, 56 R, 29, 32.1, 204/34, 35.1, 42; 428/621, 628, 632, 633, 659

[56] References Cited

U.S. PATENT DOCUMENTS 2,097,211 10/1937 Davies ..... 148/6.5
2,132,439 11/1938 Romig ..... 204/1
3,011,958 12/1961 White ..... 204/56
3,518,169 6/1970 Oyama et al. ..... 204/35
3,586,612 6/1971 Rajagopalan et al. ..... 204/56 R

*Primary Examiner*—G. L. Kaplan
*Assistant Examiner*—W. T. Leader
*Attorney, Agent, or Firm*—Kenyon & Kenyon

[57] ABSTRACT

A steel strip having an excellent phosphate-coating property is produced by subjecting at least one surface of the steel strip to electrolytic treatment in which the steel strip serves as an anode and the steel strip surface is brought into contact with an aqueous solution containing at least one phosphate selected from the group consisting of alkali metal phosphates and ammonium phosphate and having a concentration of phosphoric anions of 0.05 mole/l or more and a pH of from 4 to 7, at an anode current density of 2 $A/dm^2$ or more, to an extent that a phosphate surface layer is formed in an amount of 0.0001 to 0.05 $g/m^2$ on the metal strip surface.

9 Claims, 1 Drawing Figure

METHOD FOR PRODUCING A STEEL STRIP HAVING AN EXCELLENT PHOSPHATE-COATING PROPERTY

BACKGROUND OF THE INVENTION

1. Field of the Invention

The present invention relates to a method for producing a steel strip having at least one surface thereof which exhibits an excellent phosphate-coating property and a satisfactory appearance.

2. Description of the Prior Art

It is known that steel strips electroplated with a zinc-containing metallic material are useful as plate materials for forming car bodies and effectively prolonge the car body life. Surfaces electroplated with a zinc-containing metallic material, however, are not ideal for coating with a lacquer.

A lacquer layer coated over such a surface exhibits poor durability, especially, poor blister resistance. Therefore, the lacquer layer degrades in a short time under severe ambiant conditions.

In order to prevent the degradation of the lacquer layer, car bodies are made from steel strips having only one surface electroplated with a zinc-containing metallic material. This surface forms the inside surface of the car bodies. The other surface is not plated and forms the outside surface of the car bodies. The nonplated surface of the steel strip is effective for preventing the degradation of the lacquer layer, while the plated surface exhibits enhanced resistance to rust.

A recent trend has been for increased thickness of the plated metal layer to enhance the resistance of the steel strip to rust. In the electroplating process, it is known that the amount of electricity necessary for forming a plated metal layer increases with an increase in the thickness of the plated metal layer.

When a steel strip is plated in a continuous plating apparatus provided with a rectifier having a fixed electric capacity, the smaller the moving speed of the steel strip in the continuous plating apparatus, in other words, the longer the contact time of the steel strip with a plating liquid, the larger the thickness of the resultant plated metal layer. That is, in order to provide a large thickness of the plated metal layer, it is necessary to decrease the moving speed of the steel strip in the continuous plating apparatus. This, however, causes decreased productivity of the plated steel strip.

Usually, the electrolyte solution for the electroplating contains an aqueous solution of the sulfuric acid, which is effective for electrically stabilizing the electrolyte. If the continuous electroplating process is applied to only one surface of the steel strip at a reduced speed, the other surface of the steel strip is contaminated with various oxides derived from the electrolyte and is discolored brown, dark brown, or black. This discoloring phenomenon results not only in an undesirable appearance, but also a decreased phosphate-coating property of the other (nonplated) surface of the steel strip.

When a conversion-coating process is applied to the electroplated surface of the steel strip, the other surface of the steel strip is contaminated with a portion of the conversion-coating material. This phenomenon also results not only in an undesirable appearance, but also in a poor phosphate-coating property of the other (nonplated) surface of the steel strip.

As an approach to eliminate the above-mentioned disadvantages, Japanese Examined Patent Publication (Kokoku) No. 55–46470 discloses a method for protecting the nonplated surface of a steel strip in an electroplating process. In this method, the nonplated surface serves alternately as an anode and as a cathode. This method is effective for preventing the discoloration of the nonplated surface of the steel strip.

However, the nonplated surface of the steel strip exhibits a degraded phosphate-coating property, because frequent alternation of the polarity of the nonplated surface of the steel strip results in modification of the surface oxide layer present on the nonplated surface. This surface oxide layer is effective for enhancing the phosphate-coating property of the surface.

Also, in this electoplating process, due to the fact that the electrodes are unevenly consumed and the electrolyte flows at an uneven flow rate in the plating bath, the plated metal layer formed on the surface of the steel strip when it serves as a cathode is not always completely and uniformly removed from the surface when it serves as an anode. This is true even if the amount of current applied to the surface when it serves as a cathode is the same as that when it serves as an anode. That is, the surface of the steel strip not to be plated is sometimes contaminated with residue of the plated metal layer and/or a portion of the surface layer of the steel strip is dissolved. Accordingly, it is very difficult to provide a nonplated surface of the steel strip which is completely free from the plated metal layer and is completely protected from local corrosion thereof.

SUMMARY OF THE INVENTION

An object of the present invention is to provide a method for producing a steel strip having an excellent phosphate-coating property and a satisfactory appearance without surface discoloration and local loss of the surface layer.

Another object of the present invention is to provide a method for producing a steel strip having an excellent phosphate-coating property and a satisfactory appearance by means of an electrolytic treatment which can be carried out by using a conventional electrolytic treating apparatus.

The above-mentioned objects can be attained by the method of the present invention, which comprises subjecting at least one surface of a steel strip to electrolytic treatment in which the steel strip serves as an anode and the steel strip surface is brought into contact with an aqueous solution containing at least one phosphate selected from the group consisting of alkali metal phosphates and ammonium phosphate and having a concentration of phosphoric anions of 0.05 mole/l or more and a pH of from 4 to 7, at an anode current density of 2 $A/dm^2$ or more, to an extent that a phosphate-surface layer is formed in an amount of 0.0001 to 0.05 $g/m^2$ on the metal strip surface.

The steel strip surface to be electrolytically treated in accordance with the method of the present invention may have a temporary covering layer consisting essentially of an inorganic substance as long as the covering layer can be removed by the electrolytic treatment.

The method of the present invention is effective for providing a 0.0001 to 0.05 $g/m^2$ phosphate-coating layer which exhibits an excellent phosphate-coating property and a satisfactory steel strip surface appearance.

BRIEF DESCRIPTION OF THE DRAWING

The FIGURE is an explanatory cross-sectional view of an electrolytic treatment vessel usable for the method of the present invention.

DESCRIPTION OF THE PREFERRED EMBODIMENTS

Figure 1:
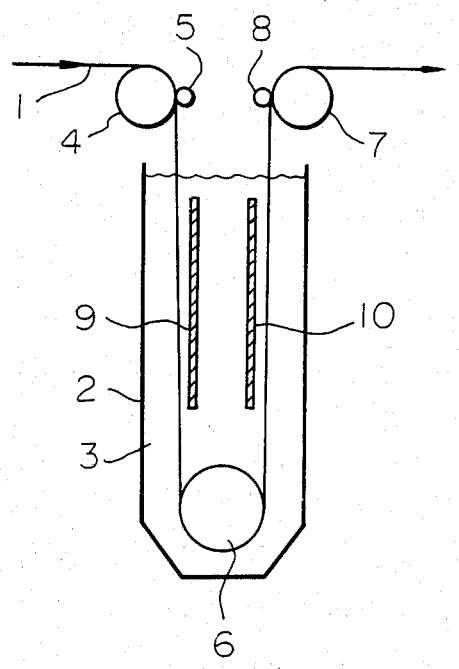

In the process of the present invention, at least one surface of a steel strip is subjected to electrolytic treatment in which the steel strip serves as an anode and which is carried out in an aqueous solution containing at least one phosphate selected from alkali metal phosphates, for example, sodium phosphate and potassium phosphate, and ammonium phosphate. Usually, the steel strip is a cold-rolled steel strip. The steel strip may have one surface thereof electroplated with a zinc-containing metallic material, for example, metallic zinc alone or an alloy containing at least 10% by weight of zinc, such as zinc-nickel, zinc-nickel-cobalt, zinc-iron, zinc-nickel-iron, and zinc-nickel-iron-chromium alloys, and the other surface thereof substantially not plated. The nonplated surface of the steel strip is subjected to the method of the present invention. The electroplated surface of the steel strip may be conversion-coated with a conversion-coating material, for example, chromate, titanate or silane compling material.

The nonplated surfce of the steel strip to be electrolytically treated in accordance with the present invention may be a clean naked surface or may have a covering layer consisting essentially of an inorganic substance. The covering layer may be a discoloring layer formed on the nonplated surface of the steel strip and derived from the electroplating process applied to the opposite surface of the steel strip. Also, the covering layer may be a temporarily plated metal layer consisting of the zinc-containing metallic material.

Furthermore, the covering layer may contain a thin layer consisting of a conversion-coating material applied to the clean surface, disclosed surface, or temporarily plated surface of the steel strip.

However, it is preferable that the covering layer be in an amount not exceeding 5 g/m$^2$. When the covering layer is a temporarily plated zinc-containing metallic layer, it is preferable that the amount of the covering layer be in the range of from 0.1 to 5 g/m$^2$. The temporarily plated metal layer can be completely removed from the steel strip by the electrolytic treatment in accordance with the present invention and is effective for enhancing the appearance and phosphate-coating property of the resultant treated steel strip surface. When the amount of the covering layer containing a temporarily plated metal layer is less than 0.1 g/m$^2$, sometimes the amount of electric current necessary for electrolytically removing from the steel strip surface, the discoloring layer derived from the electroplating process or the contaminating substance layer derived from the conversion-coating process becomes undesirably large. If the amount of the covering layer containing a temporarily plated metal layer is more than 5.0 g/m$^2$, sometimes, a large amount of electric current becomes necessary to remove the covering layer, and a portion of the plated metal is undesirably converted to crystalline phosphate of the metal.

When the temporarily plated metal layer is formed on a surface of the steel strip, undesirable dissolution of the steel strip into the electro-plating bath can be prevented. In other words, when the temporarily plated metal layer is formed, undesirable contamination of the electrolytic aqueous solution with iron ions derived from the surface layer of the steel strip can be prevented.

The electrolytic treatment is carried out in a phosphate aqueous solution containing at least one phosphate, for example, sodium, potassium, or ammonium phosphate, and having a concentration of entire phosphoric anions of 0.05 mole/l or more, preferably from 0.5 to 1 moles/l, and a pH of from 4 to 7, preferably from 4 to 6.

If the total phosphoric anions concentration of the phosphate aqueous solution is less than 0.05 mole/l, it becomes difficult to obtain at least 0.0001 g/m$^2$ of the phosphate surface layer formed on the steel strip surface.

It is preferable that the phosphate aqueous solution not be saturated with the phosphate.

In the electrolytic treatment, it is important that the pH of the phosphate aqueous solution be adjusted to 4 to 7. This adjustment can be effected by adding aqueous solutions of phosphoric acid and sodium hydroxide to the phosphate aqueous solution.

If the pH of the phosphate aqueous solution is more than 7, the resultant treated surface of the steel strip exhibits an unsatisfactory appearance.

A phosphate aqueous solution having a pH of less than 4 tends to undesirably promote dissolution of the surface layer of the steel strip into the phosphate aqueous solution. This hinders the formation of the phosphate surface layer on the steel strip surface and, therefore, results in a poor phosphate-coating property of the steel strip surface.

The electrolytic treatment in accordance with the method of the present invention is carried out at an anode current density of 2 A/dm$^2$ or more, preferably, from 2 A/dm$^2$ to 200 A/dm$^2$. When the anode current density is less than 2 A/dm$^2$, the surface layer of the steel strip cannot reach an overpassive state of iron and no phosphate surface layer is formed on the steel strip surface. Also, such a small anode current density results in a prolonged electrolytic treatment time necessary to remove the covering layer from the steel strip surface, and, therefore, the resultant appearance of the steel strip surface to be unsatisfactory.

When the anode current density applied to an electrolytic treatment system is excessively large, the voltage necessary for generating the large anode current density is also excessively large. The application of both a large voltage and a large current density naturally results in a large consumption of electric power by the electrolytic treating system. Furthermore, an excessively large anode current density undesirably promotes dissolution of the plated metal layer and the steel strip surface layer into the phosphate aqueous solution. The dissolved metals contaminate the phosphate aqueous solution. In order to prevent the abovementioned disadvantages, it is preferable that the anode current density not exceed 200 A/dm$^2$.

The electrolytic treatment is accordance with the method of the present invention can be carried out by using a direct current supplied from a full wave rectifier, single wave rectifier, three-phase full wave rectifier, or distorted wave rectifier or an alternating current having a frequency of 100 Hz or less.

The phosphate aqueous solution usable for the method of the present invention may contain, in addition to the phosphate, an agent for enhancing the conductivity of the aqueous solution. The conductivity-enhancing agent usually consists of at least one strong electrolytic inorganic salt, for example, sodium sulfate ($Na_2SO_4$) or ammonium sulfate ($(NH_4)_2SO_4$). In this case, it is preferable that the conductivity-enhancing agent be used in a concentration, in terms of anionic equivalent, of ½ or less of that of the phosphate. When the conductivity-enhancing agent contains halogen ions, for example, chlorine ions, however, it is preferable that the concentration of the halogen ions be limited to 0.01 moles/l or less. If the concentration of halogen ions is more than 0.01 moles/l, the electrolytic treatment may sometimes result in a yellow discoloration of the treated steel strip surface and a poor phosphate-coating property.

The electrolytic treatment in accordance with the present invention is carried out to form a phosphate surface layer of 0.0001 to 0.05 g/m$^2$ on the steel strip surface. When the amount of the phosphate surface layer is less than 0.0001 g/m$^2$, the resultant steel strip surface exhibits an unsatisfactory phosphate-coating property. Also, if the amount of the phosphate-coating layer is more than 0.05 g/m$^2$, the content of oxides in the phosphate-coating layer becomes undesirably large. A large content of oxides also causes the resultant steel strip surface to exhibit a poor phosphate-coating property. That is, when a steel strip surface having a phosphate-coating layer in an amount of from 0.0001 to 0.05 g/m$^2$ is subjected to a spray phosphate-coating process, the average size of phosphate crystals in the resultant phosphate-coating layer decreases from 50 microns to 15 microns. This decrease in the size of the phosphate crystals in highly effective for enhancing the lacquer-coating property of the steel strip surface.

The chemical composition of the phosphate-coating layer produced in accordance with the method of the present invention has not been completely clarified. However, it has been found from an element analysis by means of electron spectroscopy for chemical analysis and ion microanalizer (IMA) that a major component of the phosphate-coating layer is hydrated iron phosphate.

It is known that the discoloring layer can be removed by electrolytic treatment with an electrolytic aqueous solution containing a neutral salt, for example, sodium sulfate, or boric acid, in place of the phosphate, at a kpH of 4 to 7. Also, it is possible to improve the appearance of the steel strip surface by treating it with an acid aqueous solution containing, for example, sulfuric acid, nitric acid, perchloric acid, or phosphoric acid. However, it should be noted that the above-mentioned known treatments are not effective for enhancing the phosphate-coating property of the resultant steel strip surface.

In the method of the present invention, the phosphate-containing aqueous solution may contain an additive consisting of at least one sulfur compound which is effective for promoting the formation of the phosphate-coating layer on the phosphate surface layer of the steel strip. The sulfur compound can be selected from the group consisting of thiocyane compounds, for example, sodium thiocyanate; thiophene compounds, for example, 2-aminothiophene; sulfurous compounds, for example, sodium sulfite; mercaptane compounds, for example, cystine; sulfide compounds, for example, thiodiglycol; thiocarbamate compounds, for example, sodium diethyldithiocarbamate; and thiocarbamide compounds, for example, thiourea and dimethyl thiourea.

The above-mentioned effect of the sulfur compounds for promoting the formation of the phosphate-coating layer is realized by using the sulfur compound in an amount of $10^{-5}$ mole/l or more and is maximum at the amount of $10^{-1}$ mole/l.

The above-mentioned effect of the sulfur compounds can also be attained by treating the phosphate-coating layer on the steel strip surface with a solution of the sulfur compound. The treatment can be effected by immersing the steel strip having the phosphate-coating layer in the sulfur-compound containing solution or by spraying the sulfur-compound containing solution onto the surface of the phosphate-coating layer of the steel strip.

The reasons for the great effectiveness of the phosphate-coating layer formed in accordance with the method of the present invention in enhancing the phosphate-coating property of the resultant steel strip surface is not completely clear. However, the reasons are assumed to be as follows.

In the electrolytic treatment in accordance with the method of the present invention, after the covering layer is electrolytically removed, the resultant naked surface of the steel strip exhibits an electrical potential of approximately 1.5 volts based on a calomel reference electrode, and the iron in the naked surface layer of the steel strip enters an overpassive state.

In the overpassive state, the electrode reactions on the steel strip surface are as follows:

| | | |
|---|---|---|
| $2\,OH^-$ | $O_2 + 2H^+ + 2e$ | (1) |
| $Fe^\circ$ | $Fe^{3+} + 3e$ | (2) |
| $2Fe^\circ + 3H_2O$ | $\gamma Fe_2O_3 + H^+ + e$ | (3) |
| $Fe^\circ + PO_4^{3-}$ | $FePO_4.x\,H_2O$, $Fe_3(PO_4).8H_2O$ and $Fe_5H_2(PO_4)_4.4H_2O$ | (3a) |

The main electrode reaction is reaction (1), due to which oxygen is generated. Due to reactions (2) and (3), a portion of the iron in the surface layer of the steel strip is dissolved in the electrolytic solution. When the electrolytic solution contains phosphoric ions, reaction (3) is converted to reaction (3a).

When a steel strip is annealed and an oxide layer formed on a surface of the steel strip in the annealing process is removed by means of, for example, pickling, the resultant naked surface of the steel strip exhibits a property of easy formation of a very stable oxide layer on the strip steel surface. When a stable oxide layer is formed, the resultant steel strip exhibits a poor phosphate-coating property.

In the electrolytic treatment in accordance with the method of the present invention, due to the fact that the electrode reactions are effected in the overpassive state of iron and the electrolytic solution contains phosphoric ions, the resultant phosphate-coating layer contains, as an essential component, iron phosphates, for example, $FePO_4.xH_2O$, $Fe_3(PO_4)_2.8H_2$, $Fe_5H_2(PO_4).4H_2O$, etc., produced in accordance with reaction (3 a). The phosphate-coating layer is highly effective for promoting the formation of phosphate crystals thereon having an adequate size effective for enhancing the lacquer-coating property of the steel strip surface. That is, when the phosphate-coating layer is formed, the ferric phosphate crystals serve as crystal nuclei of the phosphate crystals of the phosphate-coating layer.

Also, in the phosphate-coating process, the phosphate-coating layer containing iron phosphates is highly effective for promoting the formation of phosphophyllite ($Zn_2Fe(PO_4)_2.4H_2O$) crystals, which exhibit a higher lacquer-coating property than that of hopeite ($Zn_3(PO_4)_2.4H_2O$) crystals.

The reasons for the removal of the covering layer present on the steel surface by the electrolytic treatment in accordance with the method of the present invention are not completely clear. However, it is assumed that the covering layer is removed as a result of the following phenomena.

(1) When a high voltage is applied, electric strain is generated in the covering layer. Therefore, stress is induced from the electric strain.

(2) Anions are absorbed on the covering layer surface. This results in a decrease in the surface tension of the covering layer. Therefore, the covering layer is made colloidal and then is ruptured.

(3) The covering layer is removed together with dissolving a portion of iron in the surface layer of the steel strip.

(4) The electrode reactions result in generation of oxygen gas. The covering layer is mechanically removed by the generated oxygen gas.

(5) When the covering layer is composed of a temporary plated metal layer, it is electrochemically dissolved in the phosphate aqueous solution.

(6) When the covering layer contains a conversion coating material, it is also electrochemically removed.

The additive consisting of the sulfur compound is effective for increasing the phosphate-coating layer forming rate. This is derived from the following facts. When the additive is contained in the phosphate aqueous solution, the sulfur compound is contained in the resultant phosphate-coating layer. Also, when the phosphate surface layer is treated with a sulfur compound solution, the sulfur compound is absorbed in the phosphate-coating layer due to the absorbing effect of unpaired electrons in the sulfur atoms. The sulfur compound in or absorbed in the phosphate-coating layer serves as crystal nuclei of the phosphate crystals in the phosphate-coating process. The phosphate-crystal forming rate increases with an increase in the number of the crystal nuclei.

The amount of the sulfur compound in or absorbed in the phosphate-coating layer depends on the concentration of the sulfur compound in the phosphate aqueous solution or in the treating liquid. Therefore, the phosphate-crystal forming rate in the phosphate-coating process can be easily controlled by controlling the concentration of the sulfur compound in the phosphate aqueous solution or in the treating liquid.

The electrolytic treatment in accordance with the method of the present invention may be carried out as one step of a continuous electroplating process of a steel strip with a zinc-containing metallic material. In this continuous electroplating process, for example, a steel strip is uncoiled from an uncoiler, is degreased in a degreasing vessel, is rinsed with water in a water-washing vessel, and is pickled with an acid aqueous solution in a pickling vessel. A surface of the pickled steel strip is electroplated with a zinc-containing metallic material, for example, zinc alone or a zinc-nickel alloy, in an electroplating vessel, is rinsed with water in a washing vessel, and is dried in a dryer. Thereafter, the surface of the steel strip other than the plated surface is electrolytically treated with a phosphate aqueous solution in an electrolytic treatment vessel, is washed with water in a washing vessel, is dried in a dryer, and, finally, is coiled in a coiler. The plated surface of the steel strip may be optionally coated with a conversion-coating material before the electrolytic treatment.

When the electroplating procedures were carried out, for example, so that a steel strip having a width of 1200 mm and a thickness of 0.8 mm is passed at a line speed of 40 m/min through a one-surface zinc-plating vessel containing a plating liquid containing $ZnSO_4.7H_2O$ and $H_2SO_4$ and $Na_2SO_4$ dissolved in water, the resultant plated zinc layer on one surface of the steel strip was in an amount of 80 g/m$^2$. The other surface was discolored at the outlet portion of the plating vessel.

In the continuous plating process, the surface of the steel strip other than the plated surface thereof may be temporarily plated with a zinc-containing metallic material and, optionally, may be coated with a conversion-coating material.

In this case, the amount of the resultant covering layer should be limited to the range of from 0.1 to 5 g/m$^2$.

The electrolytic treatment may be carried out by using, an electrolytic treatment apparatus, for example, one indicated in the FIGURE.

Referring to the FIGURE, a steel strip 1 is introduced into an electrolytic treatment vessel 2 containing a phosphate aqueous solution 3 therein through a pair of feed rolls 4 and 5. The roll 4 serves as a conductor roll electrically connected to an electric power source (not shown in Fig.) so that the steel strip 1 serves as an anode in the phosphate aqueous solution 3 and the roll 5 serves as a press roll to ensure the contact of the steel strip 1 with the conductor roll 4.

The steel strip 1 moves in the vessel 2 through a guide roll 6 and is withdrawn from the vessel 2 through a pair of delivery rolls 7 and 8. The roll 8 serves as a press roll to press the steel strip 1 onto the peripheral surface of the other roll 7.

A pair of cathodes 9 and 10 are places under the level of the phosphate aqueous solution 3 in the vessel 2 and between a feed portion of the steel strip 1 located between the feed rolls 4 and 5 and the guide roll 6 and a delivery portion of the steel strip located between the guide roll 6 and the delivery rolls 7 and 8. In this case, the surface of the steel strip 1 facing the cathodes 9 and 10 is electrolytically treated with the phosphate aqueous solution.

The method of the present invention has the following advantages.

(1) Since the pH of the electrolytic treatment liquid is relatively large, the amount of metals dissolved from the plated surface and the nonplated surface of the steel strip into the treatment liquid during the electrolytic treatment is small. Therefore, the steel strip performance is not degraded.

(2) Since the amount of the dissolved metals is small, the degradation of the electrolytic treatment liquid is small.

(3) Since the amount of the dissolved metals is small, the formation of deposits of metals on the cathodes is small.

(4) The electrolytically treated surface of the steel strip is not discolored yellow even after the surface is pickled.

(5) The neutral salts containing phosphoric ions exhibit a high degree of buffering effect. Therefore, the pH of the electrolytic treating liquid is stable throughout the electrolytic treatment.

The features and advantages of the present invention will be illustrated by the following examples. However, it will be understood that these examples are only illustrative and in no way limit the scope of the present invention.

EXAMPLES 1 THROUGH 12, COMPARATIVE EXAMPLES 1 THROUGH 9 AND REFERENTIAL EXAMPLES A AND B

In each of Examples 1 through 6 and Comparative Examples 1 through 9, one surface of a cold-rolled steel strip having a width of 1200 mm and a thickness of 0.8 mm was continuously electroplated in a plating liquid containing 200 g/l of $ZnSO_4.7H_2O$, 25 g/l of $H_2SO_4$, and 100 g/l of $Na_2SO_4$ and having a pH of 1.0 at a temperature of 60° C. while moving the steel strip at a line speed of 40 m/min. The surface was plated with zinc whereas the other surface of the steel strip was not plated and was discolored dark brown. The above-mentioned electroplating process will be referred to as a "zinc-plating process" hereinafter.

In Examples 7 through 12, the same plating procedures as those described above were carried out with the following exceptions.

In Example 7, the plating liquid contained 150 g/l of $ZnSO_4.7H_2O$, 200 g/l of $NiSO_4.7H_2O$, 6 g/l of $H_2SO_4$, and 100 g/l of $Na_2SO_4$ and a pH of 1.5. The resultant plating layer on the steel strip surface consisted of a zinc based-nickel alloy containing 15% by weight of nickel.

This plating process will be referred to as a "zinc-nickel (15%) plating process" hereinafter.

In Example 8, the plating liquid contained 150 g/l of $ZnSO_4.7H_2O$, 200 g/l of $NiSO_4.7H_2O$, 10 g/l of $CoSO_4.7H_2O$, 6 g/l of $H_2SO_4$, and 100 g/l of $Na_2SO_4$ and had a pH of 1.8. The resultant plating layer consisted of a zinc-based-nickel-cobalt alloy containing 12% by weight of nickel and 0.2% of cobalt. This plating process will be referred to as a "zinc-nickel (12%)-cobalt (0.2%) plating process" hereinafter.

In Example 9, the plating liquid contained 100 g/l of $ZnSO_4.7H_2O$, 400 g/l of $FeSO_4.7H_2O$, 15 g/l of $H_2SO_4$, and 20 g/l of $(NH_4)_2SO_4$ and had a pH of 1.5. The resultant plating layer consisted of a zinc-based-iron alloy containing 15% by weight of iron. This type of plating process will be referred to as a "zinc-iron (15%) plating process" hereinafter.

In Example 10, the plating liquid contained 150 g/l of $ZnSO_4.7H_2O$, 150 g/l of $NiSO_4.7H_2O$, 60 g/l of $FeSO_4.7H_2O$, 30 g/l of $Cr_2.(S_4)_3$, and 7 g/l of $H_2SO_4$ and had a pH of 1.8. The resultant plating layer consisted of a zinc-based-nickel-iron-chromium alloy containing 11% by weight of nickel, 1.5% by weight of iron, and 0.1% by weight of chromium. This type of the plating process will be referred to as a "zinc-nickel (11%)-iron (1.5%)-chromium (0.1%) plating proess" hereinafter.

In Example 11, the plating liquid contained 150 g/l of $ZnSO_4.7H_2O$, 100 g/l of $CoSO_4.7H_2O$, 10 g/l of $H_2SO_4$, and 50 g/l of $Na_2SO_4$ and had a pH of 1.5. The resultant plating layer consisted of a zinc-based-cobalt alloy containing 2% by weight of cobalt. This type of plating process will be referred to as a "zinc-cobalt (2%) plating process" hereinafter.

In Example 12, the plating liquid contained 150 g/l of $ZnSO_4.7H_2O$, 50 g/l of $Zn(OH)_2$, 15 g/l of $Al(OH)_3$, 30 g/l of $H_3BO_3$, and 30 g/l of aluminum particles having a −250 mesh size and had a pH of 5 and a temperature of 40° C. The resultant plating layer consisted of a zinc-based-aluminum alloy containing 10% by weight of aluminum. This type of plating process will be referred to as a "zinc-aluminum (1%) composite plating process" hereinafter.

In each of Examples 1 through 12 and Comparative Example 1 through 9, the discolored (nonplated) surface of the steel strip was electrolytically treated with an electrolytic treating liquid having the composition and pH indicated in Table 1 under the conditions indicated in Table 1.

After the electrolytic treatment, a phosphate-coating layer in an amount indicated in Table 1 was formed on the steel strip surface. The appearance of the electrolytically treated surface is indicated in Table 1.

The electrolytically treated surface of the steel strip was subjected to a phosphate-coating process. That is, the surface was degreased by spraying degreasing liquid containing 20 g/l of a degreasing agent (available under a trademark of Fine Cleaner-4349 made by Nippon Parkerising Co.,) to the surface at a temperature of 55° C. for 120 seconds. The degreased surface was washed with water, and, then, the washed surface was phosphate-coated by spraying a phosphate-coating liquid containing a phosphate-coating agent (available under a trademark of Ponderite 3118 made by Nippon Parkerising Co.,) and having a free acidity of 0.5 to 0.7 points, a full acidity of 14 to 15 points, and a concentration of a promotor of 1.5 to 2.0 points, to the surface at a temperature of 50° C. for 120 seconds.

The resultant phosphate-coating layer was subjected to measurement of a size of phosphate crystals and of a ratio (P-ratio) of the amount of phosphophyllite to the sum of the amounts of phosphophyllite and hopeite. The amount of hopeite was determined by measuring an X-ray intensity of a 020 surface thereof by means of X-ray diffractiometry. Also, the amount of phosphophyllite was determined by measuring an X-ray intensity of a 100 surface thereof by means of X-ray diffractiometry. The results are shown in Table 1.

For the purpose of comparison, in Referential Example A, a conventional cold-rolled steel strip was subjected to the same phosphate-coating process as that mentioned above. Also, in Referential Example B, a surface of a cold-rolled steel strip was electroplated with zinc in the same manner as that described in Example 1 and then subjected to the same phosphate-coating process as that described above, without applying the electrolytic treatment thereto. The results of Referential Examples A and B are indicated in Table 1.

The phosphate-coating property of the steel strip of Referential Example A is satisfactory. However, in Referential Example 2 in which no electrolytic treatment was applied, the plating process caused the nonplated surface of the steel strip to exhibit a degraded phosphate-coating property. That is, in Referential Example B, the P ratio is unsatisfactorily poor and the phosphate crystal size is too large.

Also, in each of Comparative Examples 1 through 9, the resultant electrolytically treated surface of the steel strip exhibited an unsatisfactory phosphate-coating property.

Furthermore, in each of Comparative Examples 1, 5, 6, 7, and 8, the appearance of the electrolytically treated surface of the steel strip was satisfactory. That is, Comparative Example 1 shows that an electrolytic treatment liquid containing 1 mole/l of $NaSO_4$ in place of phosphate is effective for slightly improving the appearance of the steel strip surface, but is not effective for enhancing the phosphate-coating property of the surface.

Comparative Example 2 shows that an electrolytic treatment liquid containing 0.25 mole/l of $H_2SO_4$ is effective for improving the appearance of the steel strip surface but is not effective for enhancing the phosphate-coating property of the surface.

Comparative Example 3 shows that an electrolytic treatment liquid containing 0.25 mole/l of $H_3PO_4$ and having a pH of 1.0 is effective for improving the steel strip surface but not effective for enhancing the phosphate-coating property of the surface.

Comparative Example 4 shows that when the pH of the electrolytic treatment liquid containing 1 mole/l of $NaH_2PO_4$ is adjusted to 3.5, the resultant electrolytically treated surface of the steel strip exhibits a poor phosphate-coating property.

Comparative Examples 5 and 6 show that when the steel strip serves as a cathode, the resultant electrolytically treated surface of the steel strip exhibits an unsatisfactory appearance thereof and a poor phosphate-coating property.

Comparative Example 7 shows that when the electrolytic treatment is carried out at an anode current density of 1 A/dm$^2$, the resultant electrolytically treated surface of the steel strip exhibits a poor phosphate-coating property and had an unsatisfactory appearance thereof.

Comparative Example 8 shows that an electrolytic treatment liquid having a pH of 8.0 results in a poor phosphate-coating property and an unsatisfactory appearance of the electrolytically treated surface of the steel strip.

Comparative Example 9 shows that an electrolytic treatment liquid containing $NaH_2PO_4$ in an amount of 0.02 mole/l results in an unsatisfactory phosphate-coating property of the resultant electrolytically treated steel strip surface.

According to Examples 1 through 12, the steel strip surfaces electrolytically treated in accordance with the method of the present invention exhibit a satisfactory appearance thereof and an enhanced phosphate-coating property.

TABLE 1

| Example No. | | Type of electroplating process | Electrolytic treatment: Treating liquid: Electrolyte: Type | Amount (mole/l) | pH | Condition: Polarity of steel strip | Current density (A/dm$^2$) | Time (second) |
|---|---|---|---|---|---|---|---|---|
| Referential Example | A | None | — | — | — | — | — | — |
| | B | Zn—plating | — | — | — | — | — | — |
| Comparative Example | 1 | " | $Na_2SO_4$ | 1 | 5.0 | (+) | 20 | 2 |
| | 2 | " | $H_2SO_4$ | 0.25 | — | (+) | 20 | 2 |
| | 3 | " | $H_3PO_4$ | 0.25 | 1.0 | (+) | 20 | 2 |
| | 4 | " | $NaH_2PO_4$ | 1 | 3.5 | (+) | 20 | 2 |
| | 5 | " | " | " | " | (−) | 20 | 2 |
| | 6 | " | " | " | 5.0 | (−) | 20 | 2 |
| Example | 1 | " | " | " | " | (+) | 20 | 2 |
| | 2 | " | " | 0.1 | " | (+) | 20 | 2 |
| | 3 | " | " | 1 | 4.5 | (+) | 5 | 8 |
| | 4 | " | " | " | 6.5 | (+) | 20 | 2 |
| | 5 | " | " | " | 5.0 | (+) | 60 | 0.7 |
| | 6 | " | $NaH_2PO_4/Na_2SO_4$ | 1/0.3 | " | (+) | 20 | 2 |
| | 7 | Zn—Ni(15%)-plating | $NaH_2PO_4$ | 1 | " | (+) | 40 | 1 |
| | 8 | Zn—Ni(12%)-Ca(0.2%)-plating | " | " | " | (+) | 40 | 1 |
| | 9 | Zn—Fe(15%)-plating | " | " | " | (+) | 40 | 1 |
| | 10 | Zn—Ni(11%)-Fe(1.5%)-Cr(0.1%)-plating | " | " | " | (+) | 40 | 1 |
| | 11 | Zn—Co(2%)-plating | " | " | " | (+) | 40 | 1 |
| | 12 | Zn—Al(10%)-composite plating | " | " | " | (+) | 40 | 1 |
| Comparative Example | 7 | Zn—plating | " | " | " | (+) | 10 | 40 |
| | 8 | " | " | " | 8.0 | (+) | 20 | 2 |
| | 9 | " | " | 0.02 | 5 | (+) | 20 | 2 |

| Example No. | | Type of electroplating process | Phosphate surface layer: Amount ($10^{-3}$ g/m$^2$) | Appearance | Phosphate-coating property: P ratio | Crystal size (micron) |
|---|---|---|---|---|---|---|
| Referential Example | A | None | — | metallic color | 0.6–0.8 | 10–25 |
| | B | Zn—plating | — | dark brown | 0.3–0.5 | 35–100 |
| Comparative Example | 1 | " | — | locally dark brown | 0.3–0.5 | 30–50 |
| | 2 | " | — | yellowish metallic | 0.3–0.5 | 30–60 |
| | 3 | " | <0.1 | yellowish metallic | 0.4–0.6 | 25–40 |
| | 4 | " | <0.1 | yellowish metallic | 0.4–0.6 | 20–35 |
| | 5 | " | <0.1 | dark brown | 0.3–0.5 | 30–60 |
| | 6 | " | <0.1 | dark brown | 0.3–0.5 | 30–60 |
| Example | 1 | " | 5–1 | metallic color | 0.6–0.8 | 15–25 |

TABLE 1-continued

| | | | | | | |
|---|---|---|---|---|---|---|
| | 2 | " | 2–1 | metallic color | " | 15–25 |
| | 3 | " | 4–1 | metallic color | " | 13–25 |
| | 4 | " | 5–1 | metallic color | " | 17–25 |
| | 5 | " | 1.0–5 | metallic color | " | 15–25 |
| | 6 | " | 5–1 | metallic color | " | 15–25 |
| | 7 | Zn—Ni(15%)-plating | 10–3 | metallic color | " | 13–25 |
| | 8 | Zn—Ni(12%)-Ca(0.2%)-plating | " | metallic color | " | 13–25 |
| | 9 | Zn—Fe(15%)-plating | " | metallic color | " | 13–25 |
| | 10 | Zn—Ni(11%)-Fe(1.5%)-Cr(0.1%)-plating | " | metallic color | " | 13–25 |
| | 11 | Zn—Co(2%)-plating | " | metallic color | " | 15–25 |
| | 12 | Zn—Al(10%)-composite plating | " | metallic color | " | 15–25 |
| Comparative Example | 7 | Zn—plating | <0.15 | locally dark brown | 0.4–0.5 | 20–40 |
| | 8 | " | <0.1 | locally dark brown | 0.3–0.6 | 20–40 |
| | 9 | " | <0.1 | yellowish metallic color | 0.5–0.6 | 20–35 |

EXAMPLES 14 THROUGH 26 AND COMPARATIVE EXAMPLES 10 THROUGH 19

In each of Examples 14 through 26 and Comparative Examples 10 through 19, a surface of the same type of steel strip as that described in Example 1 was electroplated by the plating method indicated in Table 2 so that the other surface of the steel strip is temporarily plated with a metallic material in the amount indicated in Table 2.

The temporarily plated surface of the steel strip was electrolytically treated with the treatment liquid having the composition and the pH indicated in Table 2 under the conditions indicated in Table 2. The amount of the resultant phosphate surface layer is indicated in Table 2. Also, Table 2 shows the appearance of the treated surface of the steel strip.

Thereafter, the electrolytically treated surface of the steel strip was subjected to the same phosphate-coating process as that described in Example 1. The phosphate-coating property of the steel strip surface is indicated in Table 2.

In each of Examples 14 through 26 which were carried out in accordance with the method of the present invention, the temporary covering (plating) layer was completely removed and the resultant phosphate surface layer exhibited an excellent phosphate-coating layer.

Comparative Example 16 shows that the resultant the phosphate surface layer in an amount of less than 0.0001 g/m$^2$ exhibits an unsatisfactory phosphate-coating property.

TABLE 2

| | | Electroplating process | | Electrolytic treatment | | | | | |
|---|---|---|---|---|---|---|---|---|---|
| | | | | Treating liquid | | | Condition | | |
| | | | | Electrolyte | | | | | |
| Example No. | | Type | Amount of temporary covering layer (g/m$^2$) | Type | Amount (mole/l) | pH | Polarity of steel strip | Current density (A/dm$^2$) | Time (sec.) |
| Comparative Example | 10 | Zn—plating | 1.0 | $Na_2SO_4$ | 1 | 5.0 | (+) | 20 | 3 |
| | 11 | " | " | $H_2SO_4$ | 0.25 | — | (+) | " | " |
| | 12 | " | " | $H_3PO_4$ | " | 1.0 | (+) | " | " |
| | 13 | " | 1.5 | $NaH_2PO_4$ | 1 | 3.5 | (+) | " | " |
| | 14 | " | 1.0 | " | " | " | (−) | " | " |
| | 15 | " | 1.5 | " | 0.5 | 5.0 | (−) | 25 | " |
| Example | 14 | " | 1.0 | " | " | " | (+) | 20 | " |
| | 15 | " | 1.5 | " | 1 | " | (+) | 30 | " |
| | 16 | " | 1.0 | " | " | 4.5 | (+) | 25 | " |
| | 17 | " | 0.5 | " | " | 6.5 | (+) | 10 | 5 |
| | 18 | " | 0.7 | " | " | 5.0 | (+) | 80 | 1 |
| | 19 | " | 0.8 | " | 0.1 | " | (+) | 25 | 3 |
| | | | | " | 1 | | | | |
| | 20 | | 0.7 | $Na_2SO_4$ | 0.3 | " | (+) | 20 | " |
| | 21 | Zn—Ni(15%)-plating | " | $NaH_2PO_4$ | 1 | 4.7 | (+) | 50 | 1.5 |
| | 22 | Zn—Ni(12%)-Co(0.2%)-plating | " | " | " | " | (+) | " | " |
| | 23 | Zn—Fe(15%)-plating | " | " | " | " | (+) | " | " |
| | 24 | Zn—Ni(11%)-Fe(1.5%)-Cr(0.1%) plating | " | " | " | " | (+) | " | " |
| | 25 | Zn—Co(2%)-plating | " | " | " | " | (+) | " | " |

TABLE 2-continued

| | | | | | | | | | |
|---|---|---|---|---|---|---|---|---|---|
| | 26 | Zn—Al(10%)-composite plating | " | " | " | " | (+) | " | " |
| | | | | " | " | | | | |
| Comparative Example | 16 | Zn—plating | 0.6 | $Na_2SO_4$ | 1.5 | 5.0 | (+) | 20 | 3 |
| | 17 | " | 0.5 | $NaH_2PO_4$ | 0.02 | " | (+) | " | " |
| | 18 | " | 0.7 | " | 1 | " | (+) | 1 | 60 |
| | 19 | " | 1.0 | " | " | 7.5 | (+) | 20 | 4 |

| | Example No. | Electroplating process: Type | Electroplating process: Amount of temporary covering layer ($g/m^2$) | Phosphate surface layer: Amount ($10^{-3}g/m^2$) | Phosphate surface layer: Appearance | Phosphate-coating property: P ratio | Phosphate-coating property: Crystal size (micron) |
|---|---|---|---|---|---|---|---|
| Comparative Example | 10 | Zn—plating | 1.0 | — | yellowish metallic | 0.3–0.5 | 30–50 |
| | 11 | " | " | " | yellowish metallic | " | 30–60 |
| | 12 | " | " | <0.1 | metallic | 0.4–0.6 | 25–40 |
| | 13 | " | 1.5 | " | " | " | 20–35 |
| | 14 | " | 1.0 | " | dark brown | 0–0.1 | 15–30 |
| | 15 | " | 1.5 | " | " | " | " |
| Example | 14 | " | 1.0 | 5–1 | metallic | 0.6–0.8 | 15–25 |
| | 15 | " | 1.5 | 10–3 | " | " | 13–25 |
| | 16 | " | 1.0 | " | " | " | 15–25 |
| | 17 | " | 0.5 | 5–1 | " | " | " |
| | 18 | " | 0.7 | 25–10 | " | " | 15–30 |
| | 19 | " | 0.8 | 5–1 | " | " | 17–26 |
| | 20 | | 0.7 | " | " | " | 18–25 |
| | 21 | Zn—Ni(15%)-plating | " | 10–5 | " | " | 10–25 |
| | 22 | Zn—Ni(12%)-Co(0.2%)-plating | " | " | " | " | " |
| | 23 | Zn—Fe(15%)-plating | " | " | " | " | " |
| | 24 | Zn—Ni(11%)-Fe(1.5%)-Cr(0.1%) plating | " | " | " | " | " |
| | 25 | Zn—Co(2%)-plating | " | " | " | " | " |
| | 26 | Zn—Al(10%)-composite plating | " | " | " | " | " |
| Comparative Example | 16 | Zn—plating | 0.6 | <0.1 | yellowish metallic | 0.4–0.6 | 20–30 |
| | 17 | " | 0.5 | " | yellowish metallic | " | 20–25 |
| | 18 | " | 0.7 | " | locally dark brown | " | 20–40 |
| | 19 | " | 1.0 | " | locally dark brown | " | 25–40 |

EXAMPLES 27 THROUGH 35

In each of Examples 27 through 35, the same electroplating procedures as those described in Example 14 were carried out. Then, the resultant zinc-plated surface of the steel strip was treated with a conversion-coating agent of the type indicated in Table 3. The amount of the resultant covering layer formed on the other surface of the steel strip is indicated in Table 3. The steel strip was subjected to electrolytic treatment under the conditions indicated in Table 3 and then to a phosphate-coating process in the same manner as that described in Example 1.

The amount and appearance of the resultant phosphate surface layer are indicated in Table 3. Also, Table 3 shows the phosphate-coating property of the phosphate surface layer.

Table 3 shows that phosphate electrolytic treatment was applied to a surface of the steel strip having a temporarily plating and conversion-coating layer, in accordance with the method of the present invention, the temporary layer was satisfactorily removed, and the resultant phosphate-coating layer exhibited a satisfactory phosphate-coating property.

TABLE 3

| Example No. | Electroplating process | Conversion coating process | Amount of temporary covering layer $g/m^2$ | Electrolytic treatment: Treating liquid: Electrolyte: Type | Electrolytic treatment: Treating liquid: Electrolyte: Amount mole/l | Electrolytic treatment: Treating liquid: pH | Electrolytic treatment: Condition: Polarity of steel strip | Electrolytic treatment: Condition: Current density ($A/dm^2$) | Electrolytic treatment: Condition: Time (sec) |
|---|---|---|---|---|---|---|---|---|---|
| Example | | | | | | | | | |
| 27 | Zn—plating | Chromate | 1.0 | $NaH_2PO_4$ | 1 | 5.0 | (+) | 50 | 1.5 |
| 28 | " | Silane-coupling | " | " | " | " | " | " | " |
| 29 | " | Titanate | " | " | " | " | " | " | " |
| 30 | Zn—Ni(15%)-plating | Chromate | 0.7 | " | " | " | " | " | " |
| 31 | Zn—Ni(12%)-Co(0.2%)-plating | " | " | " | " | " | " | " | " |
| 32 | Zn—Fe(15%)-plating | " | " | " | " | " | " | " | " |
| 33 | Zn—Ni(11%)-Fe(15%)- | " | " | " | " | " | " | " | " |

TABLE 3-continued

| | | | | | | | | | |
|---|---|---|---|---|---|---|---|---|---|
| | Cr(0.1%)-plating | | | | | | | | |
| 34 | Zn—Co(2%)-plating | " | " | " | " | " | " | " | " |
| 35 | Zn—Al(10%) composite plating | " | " | " | " | " | " | " | " |

| Example No. | Electroplating process | Phosphate-coating layer: Amount ($10^{-3}$ g/m$^2$) | Phosphate-coating layer: Appearance | Phosphate-coating property: P ratio | Phosphate-coating property: Size of crystals (micron) |
|---|---|---|---|---|---|
| Example | | | | | |
| 27 | Zn—plating | 10–5 | metallic | 0.6–0.8 | 15–25 |
| 28 | " | " | " | 0.6–0.8 | 15–25 |
| 29 | " | " | " | 0.6–0.8 | 15–25 |
| 30 | Zn—Ni(15%)-plating | " | " | " | " |
| 31 | Zn—Ni(12%)-Co(0.2%)-plating | " | " | " | " |
| 32 | Zn—Fe(15%)-plating | " | " | " | " |
| 33 | Zn—Ni(11%)-Fe(15%)-Cr(0.1%)-plating | " | " | " | " |
| 34 | Zn—Co(2%)-plating | " | " | " | " |
| 35 | Zn—Al(10%) composite plating | " | " | " | " |

EXAMPLES 36 THROUGH 54

In each of Examples 36 through 53, a surface of the same type of a steel strip as that described in Example 1 was electroplated in the method indicated in Table 4. In Examples 38, 46, and 50, the plated surface was conversion-coated with chromate.

Next, the other surface of the steel strip was electrolytically treated with an electrolytic treatment liquid having the composition and pH indicated in Table 4 under conditions indicated in Table 4.

In Example 39 through 53, the treating liquids contained one or two sulfur compounds.

The electrolytically treated steel strip was subjected to the same phosphate-coating process as that described in Example 1. In the phosphate-coating process, a phosphate-coating layer forming time, i.e., the time in seconds necessary for completing the formation of the phosphate-coating layer, was determined.

In Referential Examples A, B, and C, the phosphate-coating-layer forming time was also determined.

Comparing Examples 35 to 37 with Examples 38 through 52, it is clear that the sulfur compounds contained in the electrolytic treatment liquid is significantly effective for decreasing the phosphate-coating-layer forming time.

TABLE 4

| Example No. | | Electroplating process | Conversion coating process | Amount of temporary covering layer (g/m$^2$) | Electrolytic treatment Treating liquid: Electrolytic: Type | Electrolytic: Amount (mole/l) | Sulfur compound: Type | Sulfur compound: Amount mole/l | Type | Amount (mole/l) | PH |
|---|---|---|---|---|---|---|---|---|---|---|---|
| Referential Example | A | None | — | — | — | — | — | — | — | — | — |
| | B | Zn—plating | — | — | $NaH_2SO_4$ | " | — | — | — | — | — |
| Example | 36 | " | — | — | " | " | — | — | — | — | 5.0 |
| | 37 | " | — | 1.0 | " | " | — | — | — | — | 4.5 |
| | 38 | " | Chromate | 1.0 | " | " | — | — | — | — | 5.0 |
| | 39 | " | — | — | " | " | Thio-urea | $10^{-4}$ | — | — | " |
| | 40 | " | — | — | " | " | Thio-urea | $10^{-3}$ | — | — | " |
| | 41 | " | — | — | " | " | Thio-urea | $10^{-2}$ | — | — | " |
| | 42 | " | — | — | " | " | Thio-urea | $10^{-1}$ | — | — | " |
| | 43 | " | — | — | " | " | L-cys-tine | $10^{-2}$ | — | — | " |
| | 44 | " | — | — | " | " | *1 | " | — | — | " |
| | 45 | " | — | 1.0 | " | " | *1 | " | — | — | 4.5 |
| | 46 | " | Chromate | 1.0 | " | " | *1 | " | — | — | 5.0 |
| | 47 | " | — | 0.8 | " | " | Thio-urea | $10^{-4}$ | *1 | $10^{-3}$ | " |
| | 48 | Zn—Ni(15%) | — | 0.7 | " | " | Thio- | $10^{-3}$ | — | — | " |
| | 49 | Zn—Ni(12%)-Co(0.2%) plating | — | 0.7 | " | " | " | $10^{-4}$ | L-Cys-tine | $10^{-2}$ | " |
| | 50 | Zn—Fe(15%) plating | Chromate | 0.7 | " | " | L-Cys-tine | $10^{-3}$ | *1 | $10^{-3}$ | " |
| | 51 | Zn—Ni(11%)-Fe(1.5%)-Co(0.1%) plating | — | 0.7 | " | " | L-Cys-tine | " | " | " | " |
| | 52 | Zn—Co(2%) | — | 0.7 | " | " | L-Cys- | " | " | " | " |

TABLE 4-continued

| | | | | | | | | | | |
|---|---|---|---|---|---|---|---|---|---|---|
| | 53 | plating Zn—Al(10%) composite plating | — | 0.7 | " | " | tine L-Cys-tine | " | " | " | " |
| Refer-ential Example | C | None | — | — | — | " | — | — | — | — | — |

| | | | Electrolytic treatment Condition | | | | Phosphate-coating property | | |
|---|---|---|---|---|---|---|---|---|---|
| Example No. | | Electroplating process | Polarity of steel strip | Current density (A/dm²) | Time (sec) | Amount of phosphate surface layer ($10^{-3}$ g/m²) | Phosphate coating layer-forming time (sec) | P ratio | Size of crystals (micron) |
| Refer-ential Example | A | None | — | — | — | — | 45 | 0.6–0.8 | 10–25 |
| | B | Zn—plating | — | — | — | — | 100 | 0.3–0.5 | 35–100 |
| Example | 36 | " | (+) | 20 | 2 | 5–1 | 45 | 0.6–0.8 | 15–25 |
| | 37 | " | " | 25 | 3 | 10–3 | 50 | " | " |
| | 38 | " | " | 50 | 1.5 | 10–5 | " | " | " |
| | 39 | " | " | 20 | 2 | 5–1 | 40 | " | " |
| | 40 | " | " | " | " | " | 30 | 0.7–0.8 | 10–20 |
| | 41 | " | " | " | " | " | 25 | " | " |
| | 42 | " | " | " | " | " | " | " | " |
| | 43 | " | " | " | " | " | 30 | " | " |
| | 44 | " | " | " | " | " | " | " | " |
| | 45 | " | " | 25 | 3 | 10–3 | " | " | 10–25 |
| | 46 | " | " | 50 | 1.5 | 20–10 | " | " | " |
| | 47 | " | " | " | " | " | " | " | " |
| | 48 | Zn—Ni(15%) | " | " | " | " | " | " | " |
| | 49 | Zn—Ni(12%)-Co(0.2%) plating | " | " | " | " | " | " | " |
| | 50 | Zn—Fe(15%) plating | " | " | " | " | " | " | " |
| | 51 | Zn—Ni(11%)-Fe(1.5%)-Co(0.1%) plating | " | " | " | " | " | " | " |
| | 52 | Zn—Co(2%) plating | " | " | " | " | " | " | " |
| | 53 | Zn—Al(10%) composite plating | " | " | " | " | " | " | " |
| Refer-ential Example | C | None | — | — | — | — | 50 | 0.4–0.6 | 40–100 |

Note:
*1 - Sodium diethyl dithiocarbamate

We claim:

1. A method for producing a steel strip having one steel surface thereof exhibiting an excellent phosphate-coating property and the other surface thereof electroplated with a zinc-containing metallic material, comprising subjecting a steel strip having one steel surface and the other surface thereof electroplated with a zinc-containing metallic material to an electrolytic treatment in which said steel surface of said steel strip is brought into contact with an aqueous solution containing at least one phosphate selected from the group consisting of alkali metal phosphates and ammonium phosphate and having a concentration of phosphoric anions of 0.05 mole/l or more and a pH of from 4 to 7, the steel surface portion of said steel strip serves as an anode, the electrical potential of said anode is adjusted to a level at which the iron in the steel strip enters an overpassive state and the anode current density is adjusted to 2 A/dm² or more, to an extent that the steel surface of said steel strip is made clean and a phosphate surface layer is formed in an amount of from 0.0001 to 0.05 g/m² on the steel surface of said steel strip.

2. The method as claimed in claim 1, wherein said steel surface of said steel strip to be electrolytically treated has a temporary covering layer consisting essentially of an inorganic substance and said covering layer is removed during said electrolytic treatment.

3. The method as claimed in claim 2, wherein said covering layer is in an amount not exceeding 5 g/m².

4. The method as claimed in claim 2, wherein said temporary covering layer comprises a zinc-containing metallic material temporarily plated on said steel surface of said steel strip to be electrolytically treated.

5. The method as claimed in claim 4, wherein said covering layer contains a temporary conversion-coating layer formed on said temporarily plated zinc-containing metallic material layer.

6. The method as claimed in claim 4, wherein said covering layer is in an amount of 0.1 to 5 g/m².

7. The method as claimed in claim 1, wherein said aqueous phosphate solution contains an additive consisting of at least $10^{-5}$ mole/l of at least one sulfur compound containing sulfur atoms having unpaired electrons.

8. The method as claimed in claim 1, wherein said aqueous solution contains a conductivity-enhancing agent consisting of at least one strong electrolytic inorganic salt in a concentration in terms of anionic equivalent of ½ or less of that of said phosphate.

9. A steel strip produced by the method as claimed in any one of claims 1 to 8, which steel strip has one steel surface thereof exhibiting an excellent phosphate-coating property and the other surface thereof electroplated with a zinc-containing metallic material.

* * * * *

UNITED STATES PATENT AND TRADEMARK OFFICE

CERTIFICATE OF CORRECTION

PATENT NO. : 4,522,892

DATED : June 11, 1985

INVENTOR(S) : Y. Shindow et al.

It is certified that error appears in the above-identified patent and that said Letters Patent is hereby corrected as shown below:

Column 1, line 15, change "prolonge" to --prolong--.

Column 1, line 22, change "ambiant" to --ambient--.

Column 3, line 28, change "surfce" to --surface--.

Column 5, line 33, change "crystals in" to --crystals is--.

Column 6, line 58, change "$Fe_3(PO_4)_2.8H_2$" to --$Fe_3(PO_4)_2.8H_2O$--.

Column 10, line 5, change "Example" to --Examples--.

Column 14, line 40, omit "the" <u>after</u> "resultant".

Column 16, line 48, change "porarily" to --porary--.

Signed and Sealed this

*Seventeenth* Day of *December 1985*

[SEAL]

*Attest:*

DONALD J. QUIGG

*Attesting Officer*

*Commissioner of Patents and Trademarks*